US007111597B2

(12) United States Patent
Manole et al.

(10) Patent No.: US 7,111,597 B2
(45) Date of Patent: Sep. 26, 2006

(54) VALVE DEACTIVATOR LATCHING ASSEMBLY

(75) Inventors: Ioan Manole, Chesterfield, MI (US); Burak A. Gecim, Rochester Hills, MI (US); William C. Albertson, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 42 days.

(21) Appl. No.: 11/061,137

(22) Filed: Feb. 18, 2005

(65) Prior Publication Data

US 2006/0185635 A1 Aug. 24, 2006

(51) Int. Cl.
*F01L 1/34* (2006.01)

(52) U.S. Cl. ..... 123/90.16; 123/90.39

(58) Field of Classification Search ..... 123/90.12, 123/90.13, 90.16, 90.39, 90.44, 90.45, 90.46, 123/90.48, 90.52, 90.58, 90.59
See application file for complete search history.

(56) References Cited

U.S. PATENT DOCUMENTS 6,321,704 B1 11/2001 Church et al.
6,578,535 B1 6/2003 Spath et al.
6,681,734 B1 1/2004 Albertson
6,688,266 B1 * 2/2004 Church et al. ..... 123/90.16

* cited by examiner

*Primary Examiner*—Thomas Denion
*Assistant Examiner*—Ching Chang
(74) *Attorney, Agent, or Firm*—Kathryn A. Marra

(57) ABSTRACT

A valve deactivator latching assembly for selective hydraulic pressure actuation of engine cylinder valves, where the valve actuator is received by and positionable within a bore formed in an engine block with an outer body having an annular latching groove formed on its interior surface, an inner body member insertable in the outer body, a plunger, a lost motion spring, and a latch assembly including a semi-collar member of a radially displacable cooperating axial-position locking element and a second semi-collar member of a radially displacable cooperating axial-position locking element spring biased to extend radially and compressible to contracted position by hydraulic pressure, where each of the semi-collar members include a female alignment guide and a male alignment guide that continuously maintain the alignment thereof.

18 Claims, 5 Drawing Sheets

VALVE DEACTIVATOR LATCHING ASSEMBLY

I. FIELD OF THE INVENTION

This invention relates to valve deactivator assemblies for internal-combustion engines. More particularly, the invention provides a novel valve deactivator assembly incorporating a new latching element structure for use with overhead-cam roller-follower and overhead-valve pushrod type valve trains.

II. BACKGROUND OF THE INVENTION

Valve deactivator lifter assemblies are used in connection with an overhead cam valve train of an internal combustion engine or for engines with overhead-valve pushrod type valve trains. One type of valve deactivator for overhead cam engines is a stationary hydraulic lash adjuster ("SHLA") such as those described in commonly owned U.S. Pat. No. 6,681,734 and U.S. Pat. No. 6,584,942. Typically, a preselected number of the engine cylinders are equipped with a deactivator connected to an associated intake engine poppet valve. In a latched condition, the deactivator is locked allowing for normal operation of the valve train. Movement of the latch assembly from the latched position to the unlatched position is achieved by increasing engine oil hydraulic pressure in a specific designated fluid circuit. In this position, engine poppet valve is deactivated.

For a valve train, prior art deactivator lifting assemblies include latching elements typically in the form of using circular pins between inner and the outer bodies of the deactivator where the pins co-act with a receiving groove where the circular pin has a somewhat flattened base. A deactivator lifter assembly, upon driver selection or predetermined road conditions, introduces sufficient lost motion into the valve train so to retain a cylinder poppet valve in the closed position. Accordingly, a deactivator lifter assembly, includes a latch assembly, switchable between a latched (poppet valve active) and unlatched (poppet valve deactivated) condition.

Notwithstanding the usefulness of the above-constructs a need still exists for enhancing reliable operability and structural integrity of valve deactivators.

III. SUMMARY OF THE INVENTION

This invention provides a deactivating lash adjuster structure overcoming problems with prior art designs.

An objective of the invention is to improve the vehicle fuel economy.

A further object of this invention is to provide a deactivator with an improved structure that replaces conventional hydraulic lash adjuster assemblies used in valve trains.

Another object of the invention is to provide a latching semi-collar assembly having an enlarged "shear" contact surface area based on the width of the collars over a generally full circular perimeter to better resist shear under axial loading and better resist local surface wear.

Still another object of the invention is to provide a structure experiencing reduced unit loading in a latched state based on a large overlapping load-bearing area.

Yet another object of the invention is to provide a latching assembly relying on flat collars to effectively maintain alignment between a latching collar and a latch collar receiving groove.

A further object of the invention is provided an enhanced "shear cross section" area, based on the width and the diameter of a latching collar.

A still further object of the invention is to minimize the height of a latching element by dispensing with the need for a circular anti-rotation pin.

Yet a further stated but not final object of the invention is to mating collar elements that serve both as a self-guiding alignment feature during radial motion and as a "seal" against leakage of pressurized oil.

These and other objects of the invention are satisfied by a valve deactivation assembly for selective actuation of engine cylinder valves, where the valve actuator is received by and positionable within a gallery having a bore that includes supply and exhaust passages for supplying and discharging pressurized hydraulic fluid for switching the actuator between a latched, valve active condition and an unlatched, valve deactivated condition; said latch collar assembly. The assembly includes an outer body member having an interior perimetric surface and a generally annular latching groove and an inner body member having an exterior perimetric surface where the exterior perimetric surface has a diameter corresponding to the interior perimetric surface. The inner body member is disposed within the outer body member and is axially translatable relative thereto when the actuator is in the unlatched condition. The inner body is spring biased toward an axially extended position relative to the outer body member by a lost motion spring. The latch assembly included a latch member incorporating a first member of a radially displacable cooperating axial-position locking element and a second member of a radially displacable cooperating axial-position locking element where the first and second members are biased in a first radially extended position to project into the annular latching groove. The latch members are also compressible to a second radially contracted position by hydraulic pressure to generally conform to the exterior perimetric surface of the inner member. The first member has a first cooperating element of an alignment guide and the second member has a second cooperating element of the alignment guide where the first and second cooperating elements coact to maintain the radial alignment of the first and second members relative to each other and the annular groove.

Still other objects of the invention are satisfied by a method of deactivating a cylinder valve with an assembly by applying hydraulic fluid through supply passages at a pressure sufficient to radially compress the above-described first and second radially displacable members and unlatch the latch collar assembly.

The invention herein relies in part on the cooperation of matable, displacable, semi-collar elements, that provide large overlapping load-bearing areas between, on the one hand, a latching semi-collar surface and the inner body of an associated assembly groove, and on the other hand, an outer body engaging surface and a base surface of the latching semi-collar.

The invention provides for displacement-on-demand for overhead cam, roller-finger-follower valve trains by deactivating the valves of an associated cylinder. The invention also is usable for de-activating one of the two intake valves for improvement of charge motion at light loads. The invention also permits use with a production follower where it facilitates switching between full lift and zero lift or may be used with a two-step follower. In the two step follower mode, the invention adds a third step (i.e. zero lift) to the high-lift and the low-lift profiles typically obtained from the two-step follower.

Unless conditions merit deactivating a cylinder in operation, the inventive deactivator lifter assembly herein remains in the latched state and the associated poppet valve in the openable position. However, when operational conditions change sufficiently, the latch assembly unlatches, to introduce significant lost motion into the valve train causing the poppet valve to remain closed.

In the latched state, the semi-collar latching elements of this invention provide large overlapping load-bearing areas between the inner body groove base-surface area and the latching collar base surface as well as the outer body base surface and the latching collar base surface. Hence, the unit loading is less than it is with a similar device that employs a circular pin that may have a flattened base, as known from prior art. The invention herein extends the concept of distributed contact loading to the extreme case of "flat" collars. A potential benefit of the distributed load is the possibility of a single latch carrying the entire axial load due to a malfunctioning "stuck" latching element. Also, circumferential symmetry of the flat collars maintain the flat base of the circular pin parallel to the base surface of the receiving groove at all times thereby providing an advantage over the prior art by not requiring anti-rotation prevention when using flattened-base circular latching pins now conventionally employed. Another benefit of the latching-collar design of this invention is the large "shear" surface area, based on the width of the collars and the full circular perimeter that provides better resistance to shear under axial loading. Hence, the unit loading is less than it is with a prior art assembly that employs a circular pin with a flattened base.

The invention can also be employed in an Overhead-Valve Pushrod type valve train where the hydraulic lifter is replaced with proposed actuator enabling displacement-on-demand.

For reference in the context of the invention, an assembly according to this invention in the context of an overhead cam engine will be referred to as the "De-activating SHLA". A "De-activating SHLA" or "d-SHLA" enables selective de-activation of the engine poppet valve by enabling the displacement of the rocker pivot at the position of the stationary hydraulic lash adjuster. Correspondingly, where used, "De-activating Lifter" enables the de-activation of the engine poppet valve by enabling a relative motion between those parts of the lifter that are in contact with the cam and the pushrod, respectively.

As used herein "substantially," "generally," "relatively," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

Given the following enabling description of the drawings, the inventive valve deactivation assembly should become evident to a person of ordinary skill in the art.

IV. BRIEF DESCRIPTION OF THE DRAWINGS

V. DESCRIPTION OF THE PREFERRED EMBODIMENT

Figure 1:
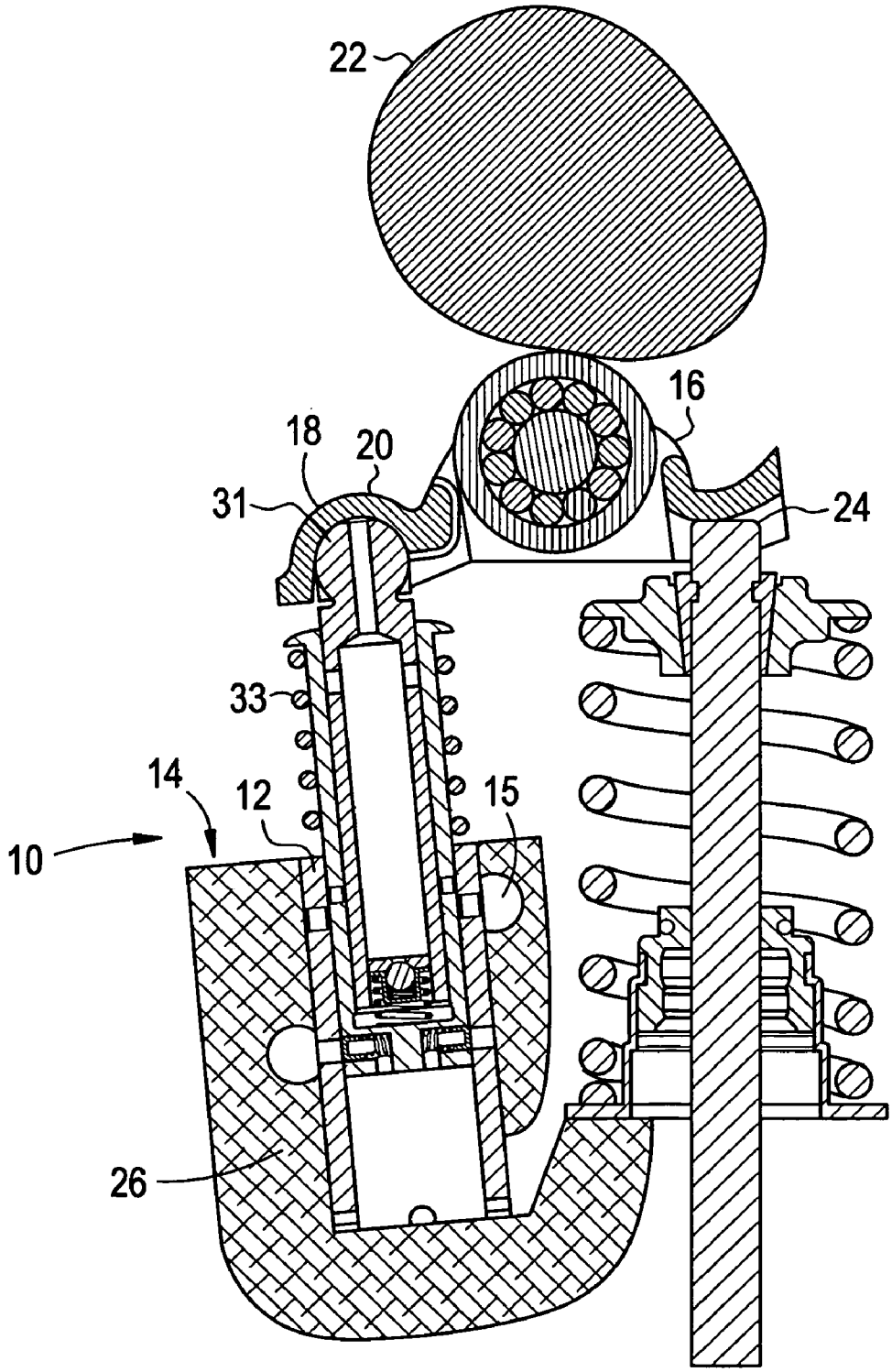
FIG. 1 is a plan cross-sectional view of a section of overhead cam internal combustion engine with a de-activating SHLA valve adjuster in accordance with a first embodiment of the invention.

The invention herein is directed to a novel valve lifter assembly combination and method for its use. Referring to FIG. 1, a de-activating SHLA 10 in accordance with an embodiment of the invention is disposed in a gallery including a cylindrical bore 12 in the engine head 14 which includes a conventional engine oil circuit 15. A rocker assembly 16 including a rocker pivot 18 and rocker SHLA socket 20 disposed at one end thereof is displaced during rotation of associated engine cam 22. In conventional operation, because the other end of the rocker 16 abuts the tip of an engine poppet-valve 24, as the cam depresses the rocker, the poppet valve 24 is also forced downwardly. Upon release of the downwardly directed force on the rocker during the rotational cycle of the cam, the spring biased upward, poppet valve 24 returns to its original extended position (illustrated in FIG. 1).

Figure 2:
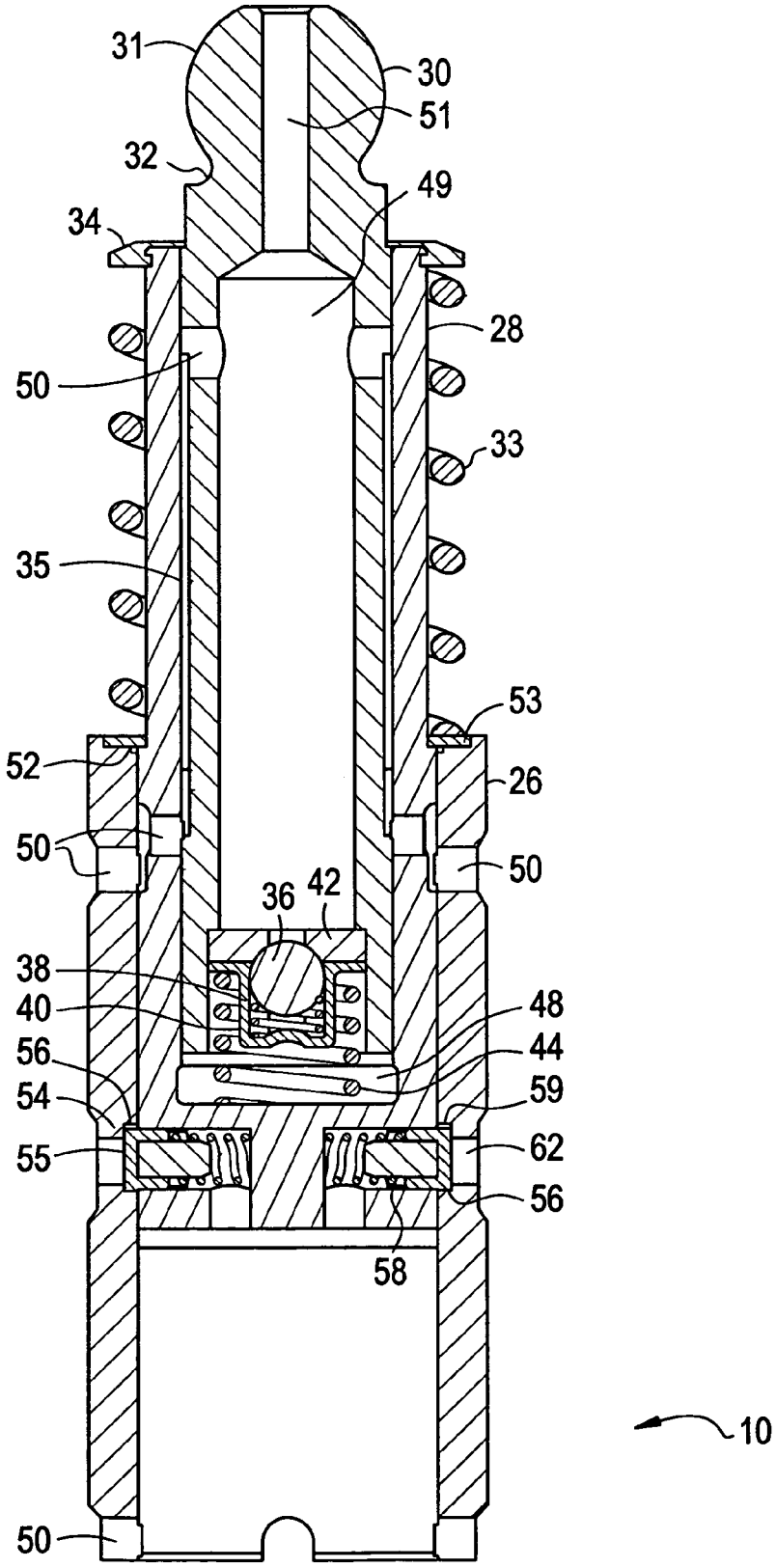
FIG. 2 is a cross-sectional side view of a de-activating SHLA valve adjuster in accordance with a first embodiment of the invention.
Figure 3:
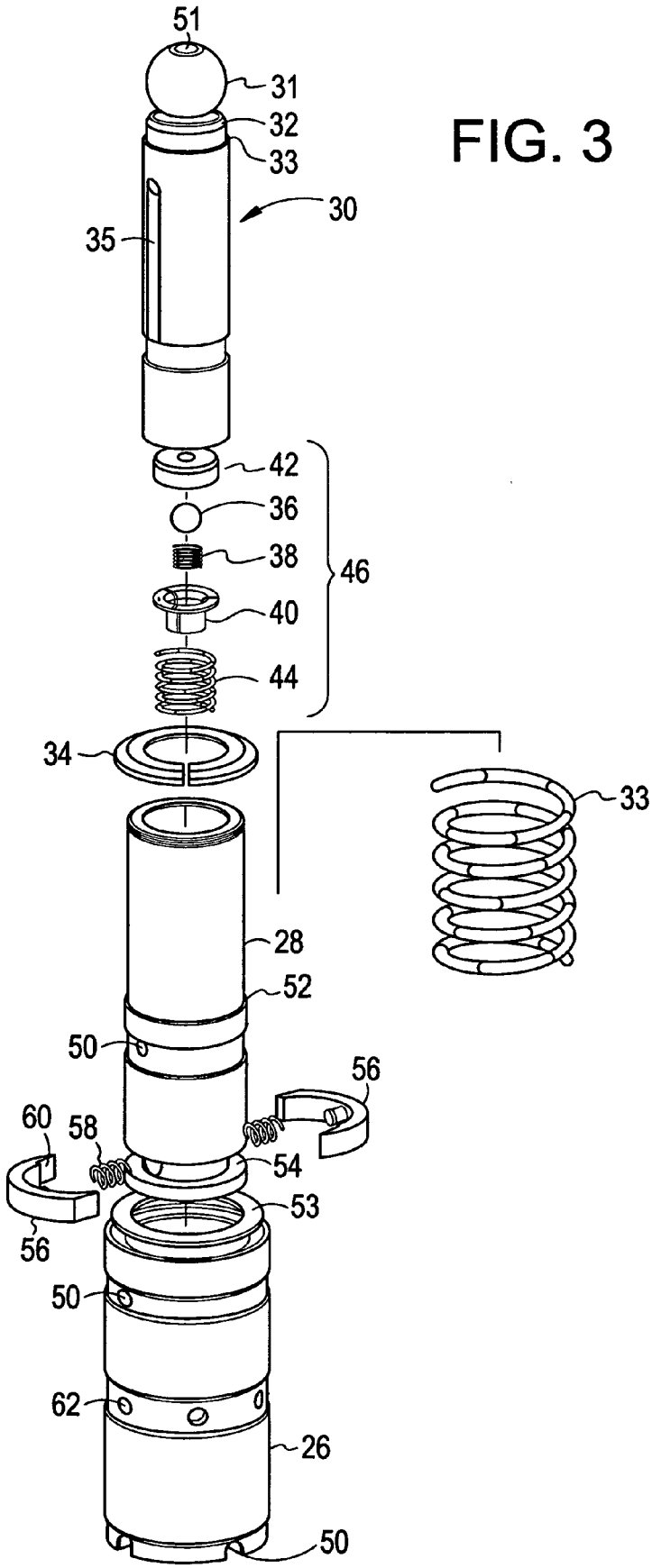
FIG. 3 is an exploded assembly view of the embodiment of FIG. 2.

Referring to FIGS. 2 and 3, one embodiment of a d-SHLA assembly 10 is illustrated in detail. The d-SHLA assembly 10 includes a generally hollow cylindrical outer body 26, a generally hollow, cylindrical inner body 28, a plunger 30, and a lost motion spring 33. The inner body 28 has an outer perimeter substantially corresponding to the inner perimeter of the outer body 26 and is inserted therein. Where non-circular geometry is used, e.g., polygonal, the perimeter of the inner body should substantially conform to the dimensions, configuration, and geometry of inner periphery of the outer body 28 but leave a small gap therebetween for actuation oil relief. The plunger 30 is secured within the inner body towards its upper end. The upper end of the plunger possesses a spherical head 31, in contrast to the typical flatter or hemispherical configuration of more conventional lash adjuster design. The intent of the more spherical configuration of the head 31 is to minimize interference by and accommodate relative rotation of the rocker socket 20 with the plunger, when the engine poppet valve 24 is in the de-activated state. The spherical plunger head 31 is separated from the main tubular body of the plunger by a radially-narrowed neck segment 32. Disposed below the neck 32 is a small annular shoulder for receiving and positionally affixing a circular retainer 34 for the lost motion spring 33. The plunger 30 also features formed along outer perimeter at least one axial lubrication channel 35 along a select length thereof.

The base of the plunger defines a one-way-flow check valve assembly 46. The check valve assembly is established by a check ball 36, a check-ball spring 38, a check ball cage 40, a check valve seat 42 and a lash adjuster spring 44. The assembly 46 is found in conventional lash adjusters and collectively provides the one-way-flow function of a check valve such as that described in U.S. Pat. No. 6,681,734. Briefly, the check valve assembly 46 is established with in the plunger base in a manner where the cage 42 is biased upwardly by the lash adjuster spring 44 and the check ball 36 biased upwardly by the check ball spring 38 against a flowthrough port in the check ball seat 42. The check valve assembly 46 permits the flow of oil from the low-pressure chamber 49 inside the plunger 30 to the variable-volume high-pressure chamber 48 formed between the lower end of the plunger and the inner body. During the lifting of the engine poppet valve 24, under load, the check ball 36 seals the port in the check valve seat 42 orifice disconnecting the low-pressure chamber 49 formed in the hollow portion of the plunger and the high-pressure chamber 48. Thus, the assembly 46 serves to eliminate lash during the base circle segment of the cam event by creating an upward movement of the plunger 30 with respect to the inner body 28.

Referring again to fluid flow, the inner body 28 and the plunger 30 features a plurality of lubrication ports 50 which communicate hydraulic pressure via axial lubrication channel 35 between the low-pressure chamber 49 and the conventional engine oil circuit 15. An axial lubrication channel 51 extends from the low pressure chamber 49 through the length of the neck 32 and the spherical head 31 of the plunger 30 to provide pressurized oil on the contact surfaces of the rocker end socket 20 and the outer surface of the plunger's spherical head 31. The lubrication channel is in hydraulic communication with the engine oil circuit through conventional means.

As more clearly illustrated in reference to FIG. 3, the inner body 28, has a section of enlarged diameter at is lower end defining a shoulder 52. The shoulder 52 receives a spring retainer 53 establishing the lower support boundary for the complementarily-dimensioned lost-motion bias spring 33. Thus, the lost motion spring is seated over the outer periphery of the outer body 26 and axially confined between the spring retainer seat 34 at the top and 53 at the bottom. The spring retainer 53 also serves as a stopping member for the upward motion of the inner body 28, thus aligning the inner body groove 54 with the outer body groove 59.

Figure 5:
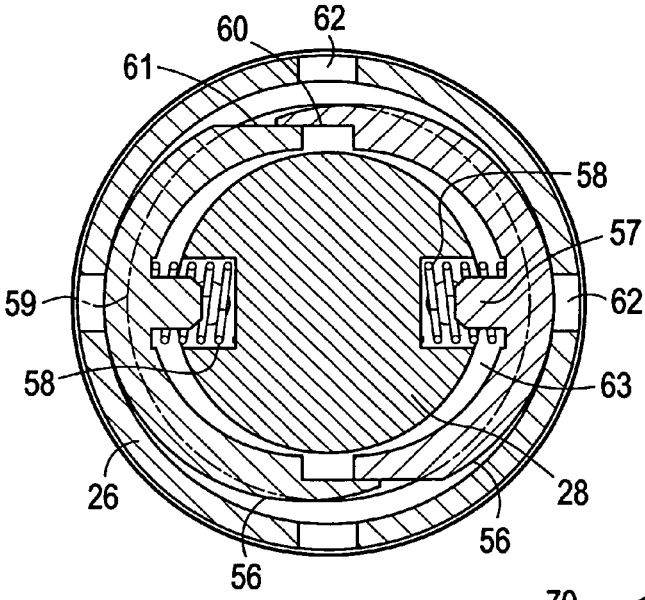
FIG. 5 is a cross-sectional top view of a semi-collar latching element assembly of the embodiment of FIG. 2.

The inner body 28 includes a full-circumferential deep groove 54 formed into its outer perimeter proximate to its lower end. The deep groove 54 is dimensioned to retain a pair of semi-collar latching element assemblies 55 when fully recessed. Each semi-collar latching assembly includes a generally semi-circular latching element 56, a spring retaining lug 57 that may be press fit or formed integrally with the latching element, and a latching element biasing spring 58. Each of the semi-collar latching element assemblies 55 is receivable in and guided within the inner body circumferential groove 54 and detented by the spring 58 towards a complementary, receiving annular groove 59 formed along interior position of the outer body 28. As illustrated in FIG. 5, when projecting in its radially extended configuration within the groove 59, (indicated by the dashed shear line), the semi-collar elements assume an elliptical/noncircular configuration. Preferably, the biasing springs 58 seat in complimentarily sized bores formed in the inner wall of the circumferential groove 54. The assemblies have a thickness substantially corresponding to the width of the grooves 54 and 59 and essentially freely slidable within the grooves.

Figure 4:
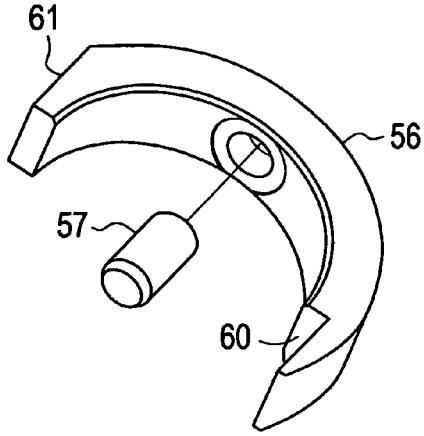
FIG. 4 is a perspective assembly view of a semi-collar latching element of the embodiment of FIG. 2.

In the embodiment illustrated in FIG. 4, each of the latching elements 56 includes complementarily configured, matable end portions. One end of the latching element defines a kerf-like portion 60 that for the purpose of this disclosure will be referred to as a female end. The other end of the latching element features a complementarily bevel/shelf-like end portion 61 configured to mate with by sliding within or insert into an opposing female portion when compressed radially. For the purpose of this disclosure that end 61 is referred herein as the male portion. The arc length of the male and female ends is sufficient to maintain overlap across the entire range of radial translation between fully expanded and fully compressed states. That is, the male and female ends are in continuous contact regardless of radial expansion or compression of the latching elements within the deep groove 54 and the receiving groove 59 of the outer body 26. Furthermore, because the ends 60 and 61 are beveled rather than straight or orthogonal, radial binding is minimized. During radial expansion and contraction, the geometry of the overlapping portions also enhances alignment of the semi-collar latching elements 56 and minimizes leakage of the pressurized oil acting on the outer perimeter thereof.

When fully extended where the male and female ends are not fully mated, the semi-collars 56 provide a somewhat elliptical cross-section but possess sufficient radial depth to maintain continuous contact between the elements 56 and the deep groove 54 of the inner body 28. Consequently, the semi-collar latching elements cannot completely clear outer perimetric surface of the inner body 28. When fully radially detented (compressed) where the male and female end are completely mated, the latching elements 56 establish a substantially unbroken circular ring where the inner perimetric surface of the ring is compresses about and against the inner body's latching groove 54 inner wall. The outer perimetric surface of the resulting ring substantially conforms to the geometry of the outer perimeter of the inner body. Consequently, the entire semi-collar assembly is recessed within the latching groove 54 and free from the outer body latching groove 59.

The latching semi-collar assemblies 55 compress due to hydraulic pressure of the engine oil/lubricant received from a dedicated hydraulic circuit. The details of the operation are described below, but for the purpose of this description, hydraulic pressure from fluid pressure acts on and induces radially-inward motion the latching semi-collar elements against the force of their respective biasing springs. To provide engine oil/lubricant multiple actuation ports 62 are located about the outer body 26 to be aligned with the outer body latching groove 59. Thus, hydraulic pressure is applied through the ports 62 directly to the peripheral annular faces of the detentable latching elements 56. In order to prevent pressure equalization at the inner and the outer surfaces of the latching elements, it is preferred that the spring retaining bores formed in the groove 54 include a pressure-relieving leakage path from the inner surface of the latching elements to the empty volume at the lower end of outer body 26. Any leakage into this lower end of the outer body can be relieved through ports 50 formed at the base of the outer body.

In the baseline state of operation, the d-SHLA 10 of this invention is in the latched position where the semi collar latching elements 56 are urged outward by their respective biasing springs 58, and the actuating ports 62 are de-pressurized. The inner body 28 remains, essentially, axially fixed with respect to the outer body 26, the two acting as one integrated entity. The axial clearance between the axial width of the latching element 56 and the axial height of the grooves 54 and 59 on the outer and the inner bodies are compensated by the downward motion of the inner body as a reaction to the lash compensating force of the plunger 30. This clearance is optimized to provide for free radial motion of latching collars for mode switching, but also to maintain sufficient pressure on the outer perimeter of the collar assembly 55 when the actuation ports 62 are pressurized. Also, the axial clearance in the groove 59 of the outer body 26 is designed to be larger than the axial clearance in the groove 54 of the inner body 28 so that any circumferential misalignment, i.e. binding caused by tilting of the latching elements 56, that may take place inside the deep groove 54 will not prevent engagement of the laterally "misaligned" collars being inserted into the receiving groove 59 of the outer body.

In the unlatched position, the collars 56 detent radially inwards against the respective bias springs 58 from the hydraulic pressure acting on the peripheral annular faces of the detentable latching elements 56. In order to prevent premature de-activation during the duration when the poppet valve 24 is "open", the actuation pressure force has to be less than the sum of the friction force between the latching elements 56 and the groove surface 59 and the biasing force of the associated latching element biasing springs 58. The timing of the pressurization with respect to the cam event is significant, in any case, the latching collars will stay latched under the axial loading due to the force from the engine poppet valve's biasing spring and the resultant lateral friction force.

Following the pressurization of the actuation port the hydraulic force at the peripheral annular faces of the detentable, semi-collar latching elements 56 push/detent the collars radially inwardly, corresponding to the base-circle event of the cam 22 where there is no axial loading except that due to the hydraulic pressure at the high-pressure chamber for lash compensation. It is important in the design of the device that for the "initial" radial motion of the latching elements, that the relative sizes of the latching elements 56 and the actuation ports 62 be matched because this relationship determines the available hydraulic force. The unlatching motion will take place as long as the hydraulic force is larger than the sum of a small friction force (due to axial loading from lash-compensation pressure) and the force of the biasing springs 58.

When the engine poppet valve 24 is in a de-activated mode, the rocker 16 pivots at the engine poppet-valve tip, and the cam 22 displaces the inner body 28 and the plunger 30 against the lost motion biasing spring 33. The axial separation between the actuation ports 62 and lubrication ports 50 prevents direct fluid communication therebetween. As a result of the relatively small radial clearance between the inner body 28 and outer body 26, during the translation of the inner body 28 within the outer body 26, downwardly or upwardly, high pressure at the actuation port is maintained. At the end of the return (upward axial movement) of the reciprocating plunger assembly 30, as the outer surface of the latching collars are still substantially recessed in the deep groove 54, they do not register with the latching groove 59 due to continuing high pressure. Therefore, re-latching of the inner and outer bodies is prevented.

To reactivate the engine poppet valve, the hydraulic fluid is vented thereby lowering pressure at the actuation ports 62. As the cam continues to rotate, only upon realignment of the outer body latching groove 59 with the latching elements recessed in the inner body latching groove 54, can the poppet valve be re-activated from its de-activated state. Re-alignment of the grooves is set to be generally coincidental to the base-circle segment of rotation of the cam. If the pressure remains above a select threshold, to overcome the spring bias of the latching collar biasing spring to maintain the engine poppet valve in the de-activated state, the reactivation will take place during the subsequent cam cycle. Notably even when the poppet valve 24 is in the de-activated mode, hydraulic communication with the lubrication channel 15 and the low-pressure chamber 49 inside the plunger is maintained to ensure proper lubricant flow to the contact between the spherical end of the plunger and the rocker socket.

Figure 6:
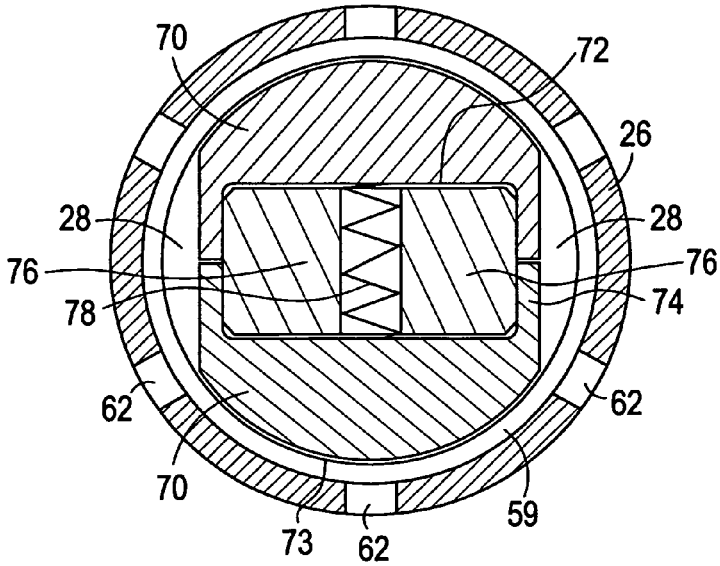
FIG. 6 is a cross-sectional top view of an alternative embodiment of a latching element assembly of the invention.

Referring to FIG. 6, it illustrates a cross-sectional view across the latching assembly of an alternative embodiment of the invention in a poppet valve active (latched) mode. In this embodiment, each of the latching elements 70 features a rectangular channel 72 formed by the side walls 74 projecting from the curved base portion 73. The channel dimensionally corresponds to the cross-section of an axially extending rectangular core section 76 of the inner body 28. Each element 70 sealingly reciprocates relative to the short sides of the rectangle defined by the core 76. As in the above-described embodiment, the side walls 74 are of a length to maintain contact with the core 76 at all times, even when fully extended. This alternative embodiment also illustrates the use of a single biasing spring 78, disposed within a throughbore formed in the core 76. As in the case of the above-described embodiments, the latching elements 70 are urged by the spring 78 to project radially in to the latching groove 59. Hydraulic pressure applied on the perimetric surface of the latching elements through actuation ports 62 can compress the latching elements to be free of both the groove 59 and the outer body 26 (as illustrated). The operation and functionality of the alternative structure is otherwise substantially the same as described above.

Figure 7:
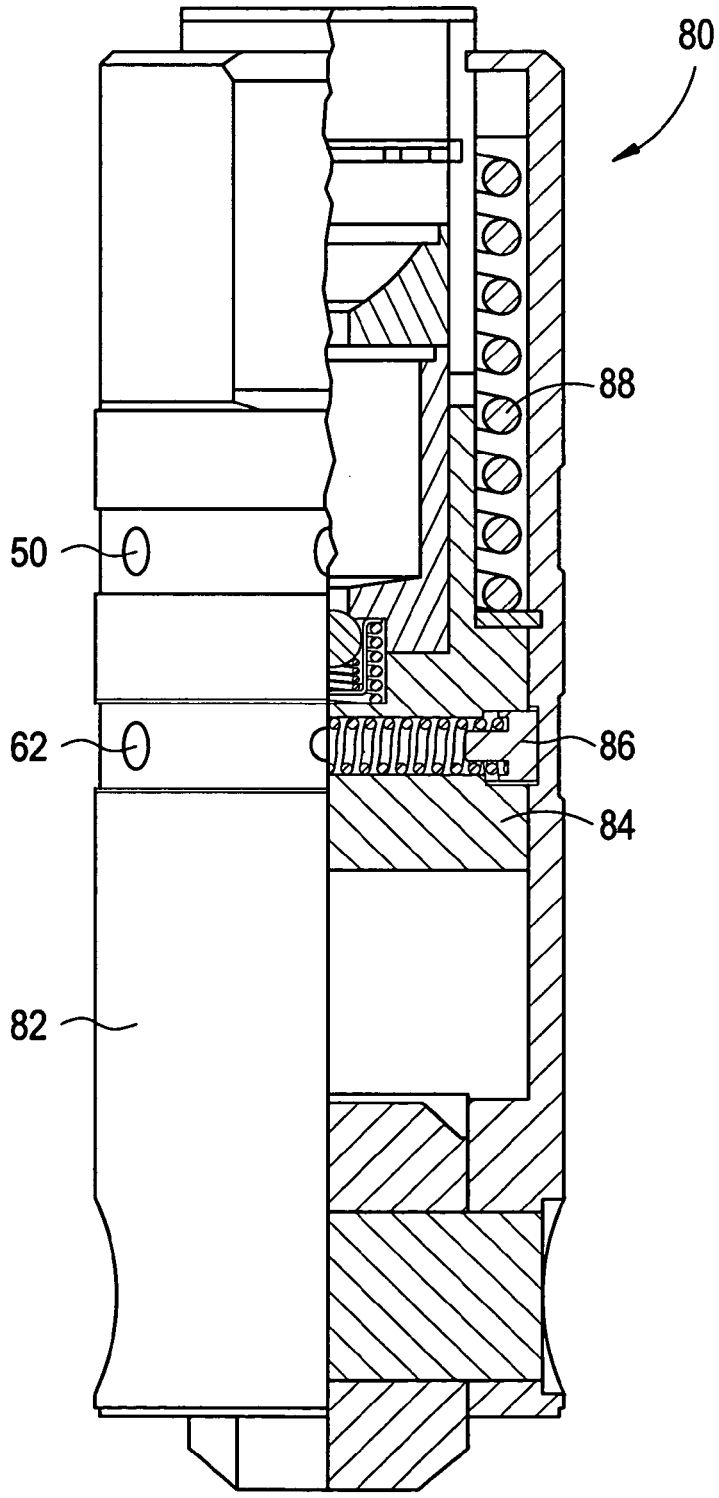
FIG. 7 is a partial cutaway side view of a lifter embodiment of the invention for use with overhead valve pushrod valvetrains, showing the proposed latching assembly.

Referring to FIG. 7, a de-activating valve lifter 80 in the latched state is depicted as an alternative embodiment of the invention applicable to the overhead valve pushrod type valvetrain. In this state where the upward displacement of the outer body 82 imparted by the cam (not shown) to the roller is transferred to the inner body 84 by means of the semi-collar latching assembly 86. Functionally, when the hydraulic actuation pressure increases, the latching semi-collar elements 86 are radially displaced inwardly from the locked position relative to the outer body 82. This displacement permits relative motion, defined as the lost motion, between the inner body 84 and the outer body 82. In the un-latched state (not illustrated), the displacement of the cam is imparted onto the outer body 82 biased by the lost-motion biasing spring 88, where the inner body 84, and the remaining valvetrain components including the engine poppet valve (not shown) remain stationary. The structure, characteristics, and function of the semi-collar latching elements described in are generally the same in this "Lifter" embodiment as that detail above in reference to the d-SHLA embodiments.

Alternatives to the foregoing embodiment include the use of a two-step follower designed to switch between full lift and zero lift enabling, stand-alone, de-activation. Accordingly, the skilled artisan will appreciate that the invention can be adapted for use in combination with, for example, a conventional overhead cam roller-finger-follower, or with a two-step follower to add deactivation feature to the high- and low-lift derived from the two-step follower.

Given the foregoing, it should be apparent that the specifically described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

We claim:

1. A valve deactivation assembly for selective actuation of engine cylinder valves, where a valve actuator is received by and positionable within a gallery having a bore that includes supply and exhaust passages for supplying and discharging pressurized hydraulic fluid for switching the actuator between a latched, valve active condition and an unlatched, valve deactivated condition; said valve deactivation assembly comprising:

an outer body member having an interior perimetric surface and a generally annular latching groove and an inner body member having an exterior perimetric surface where said exterior perimetric surface has a diameter corresponding to the interior perimetric surface, said inner body member being disposed within said outer body member and being axially translatable relative thereto when said actuator is in the unlatched condition, a lost motion spring biasing said inner body member toward an axially extended position relative to said outer body member;

a latch assembly including a latch member incorporating a first member of a radially displacable cooperating axial-position locking element and a second member of a radially displacable cooperating axial-position locking element where said first and second members are biased in a first radially extended position to project into said annular latching groove and compressible to a second radially contracted position by hydraulic pressure to generally conform to the exterior perimetric surface of the inner member, said first member having a first cooperating element of an alignment guide and said second member having a second cooperating element of said alignment guide where said first and second cooperating elements coact to maintain the radial alignment of the first and second members relative to each other and the annular groove.

2. The valve deactivation assembly according to claim 1 where said inner and outer bodies are cylindrical and said first and second members of said radially displacable cooperating axial-position locking element have a curved peripheral annular face and said first and second members of said radially displacable cooperating axial-position locking element are spring biased toward the radially expanded position by a spring.

3. The valve deactivation assembly according to claim 2 where the first member of said radially displacable cooperating axial-position locking element and said second member of said radially displacable cooperating axial-position locking element providing enhanced resistance to axial shear due to increase in a cross-sectional area defined by width and diameter of said members and where the locking elements are flat semi-collars with each alignment guides.

4. The valve deactivation assembly according to claim 3 where the first and second cooperating alignment guides are respectively matable, male and female ends.

5. The valve deactivation assembly according to claim 4 where each of the semi collars includes a male end and a female end where the male and female ends seal against leakage of the pressurized hydraulic fluid acting on the semi collars during valve deactivation.

6. The valve deactivation assembly according to claim 2 where each of the first and second locking elements include an interior channel defining a base and walls for receiving a portion of the inner body.

7. The valve deactivation assembly according to claim 6 where the spring extends through the inner body portion and against the base of the interior channels of the first and second locking elements.

8. The valve deactivation assembly according to claim 7 where the interior channel has a rectangular cross-section and the receiving portion of the inner body is rectangular.

9. An improved cylinder valve deactivation apparatus for an internal combustion engine having at least one cylinder, said apparatus comprising:

at least one valve controller for selective switching between valve actuating and valve deactivating conditions wherein at least one associated valve is operated normally in the valve actuating conditions and deactivated to remain closed in the deactivating conditions;

an engine gallery having a bore to receive a valve actuator and including supply and exhaust passages for supplying and discharging pressurized hydraulic fluid for switching between activated and deactivated conditions;

said valve actuator having a substantially hollow, tubular outer body member with an inner and outer surface, including a peripheral latching groove disposed on the inner surface thereof and actuation ports formed between said inner and outer surface for communicating pressurized hydraulic fluid to said latching groove; a tubular inner body member having an interior surface and an exterior surface for insertion into said outer body member where said exterior and a lost motion spring biasing said inner body member toward an axially extended position relative to said outer body member, a deep groove formed along a substantial portion of the outer surface of the inner body, and a plunger for axial insertion at least into part of the inner body;

a latching assembly formed by at least a pair of collar members nestable within the deep groove when in a compressed state and spring biased to slidably extend from the deep groove into the peripheral groove of the outer body, said collar members including continuously interengaged cooperating alignment elements and having a substantially flat upper and lower surfaces that define the latching shear surface area and a radially outwardly directing biasing element to bias the collar members toward said peripheral groove.

10. The improved cylinder valve deactivation apparatus of claim 9 where the collars are semi collars of identical flattened configuration and of select thickness that provide a large overlapping load bearing area to enhance shear resistance under axial loading.

11. The improved cylinder valve deactivation apparatus of claim 10 where collars include co-acting alignment elements.

12. The improved cylinder valve deactivation apparatus of claim 11 where the deep groove is continuous and the semi collars form a ring and where the alignment elements are self-guiding, interengaging male and female members disposed on each of the semi-collars.

13. The improved cylinder valve deactivation apparatus of claim 12 where the peripheral groove has a width substantially equal to the thickness of the semi-collars.

14. The improved cylinder valve deactivation apparatus of claim 13 where the ring formed by the semi-collars possess a substantially complete circular perimeter.

15. The improved cylinder valve deactivation apparatus of claim 11 where the deep groove includes a core and the collars define an interior channel for slidable engagement with an inner body core.

16. The improved cylinder valve deactivation apparatus of claim 15 where the biasing element is a spring and further including a throughbore in the core for the biasing spring.

17. The method of deactivating a cylinder valve with an assembly according to claim 1 comprising the step of applying hydraulic fluid through supply passages at a pressure sufficient to radially compress said first and second radially displacable members and unlatch the latch collar assembly.

18. The method of deactivating a valve with an assembly according to claim 9 comprising the step of applying hydraulic fluid through the actuation ports passages at a pressure sufficient to compress said first and second collar members to nest within the deep groove and unlatch the latch collar assembly.

* * * * *